US005214881A

United States Patent [19]

Borchardt

[11] Patent Number: 5,214,881

[45] Date of Patent: Jun. 1, 1993

[54] APPARATUS FOR PRODUCING DRIVING BELTS

[75] Inventor: Horst Borchardt, Burgdorf, Fed. Rep. of Germany

[73] Assignee: Herman Berstorff Maschinenbau GmbH, Hanover, Fed. Rep. of Germany

[21] Appl. No.: 923,472

[22] Filed: Aug. 3, 1992

[30] Foreign Application Priority Data

Sep. 28, 1991 [DE] Fed. Rep. of Germany ..... 4132385

[51] Int. Cl.[5] ..... B24B 7/10

[52] U.S. Cl. ..... 51/78; 51/105 R; 51/267

[58] Field of Search ..... 51/78, 79, 103 R, 105 R, 51/266, 267

[56] References Cited

U.S. PATENT DOCUMENTS 3,822,516 7/1974 Huber ..... 51/105 R X
3,891,405 6/1975 Huber ..... 51/105 R
4,322,916 4/1982 Richmond ..... 51/78
4,329,192 5/1982 White, Jr. et al. ..... 51/103 R X

FOREIGN PATENT DOCUMENTS 1043622 11/1958 Fed. Rep. of Germany .
2358964 6/1974 Fed. Rep. of Germany .

*Primary Examiner*—Bruce M. Kisliuk
*Assistant Examiner*—John A. Marlott
*Attorney, Agent, or Firm*—Foley & Lardner

[57] ABSTRACT

An apparatus for producing driving belts is improved with regard to an increased production speed, reduced energy requirements for each belt produced, and increased environmental compatibility. A semifinished belt is clamped on two rolls and is provided with a profile by means of a grinding tool containing an abrasive. The grinding tool is cooled internally whereby dry grinding can be effected, as opposed to previous wet grinding processes and the inherent disadvantages thereof.

7 Claims, 3 Drawing Sheets

APPARATUS FOR PRODUCING DRIVING BELTS

BACKGROUND OF THE INVENTION

The present invention relates to an apparatus for producing driving belts comprising a driveable clamping belt for a semifinished belt, at least one shaping grinding tool, a collecting drive for the grinding dust, and a cooling unit for the grinding process.

DESCRIPTION OF THE PRIOR ART

It is well known from DE-AS 10 43 622, for example, that driving belts can be cut in an advantageous manner from a reinforced rubber sleeve clamped on a rotary mandril. For this purpose, the rubber sleeve on the mandril is set in a rotating motion and an endless belt is cut from the sleeve at a preselected flank angle by means of one or several separating knives.

The described process has the disadvantage that due to the separating cuts being inclined with regard to the sleeve surface, an exact flank cut can only be ensured by a relatively costly and complex bearing and guiding system for the cutting knives. Moreover, this process is only suitable for the production of driving belts with a simple structure, for example, of rectangular or V-type geometry.

DE-AS 23 58 964 discloses a method and an apparatus for producing multi-component V-belts (Poly-V-belts) from a reinforced and vulcanized rubber sleeve while avoiding the disadvantages mentioned above. With this process, the sleeve is clamped on a mandril and set in a rotary motion together with the mandril. A combined shaping, profiling and separating grinding tool is then moved against the sleeve surface from the outside and produces in several grinding stages first an even sleeve surface and finally a profiling separating cut.

On the one hand, this process is suitable for producing driving belts with a high geometric accuracy over the belt circumference as well as multi-component V-belts. On the other hand, however, it presents the disadvantage of an extremely low production speed. Due to the poor thermal conductivity of the rubber, this production process can be efficiently used only when being combined with a cooling of the material to be ground, if a burning of the rubber is to be avoided while acceptable production speeds are realized. In practice this process can only be applied in the form of a wet grinding process with water being sprayed as a cooling agent between the rubber sleeve and the grinding tool. The grinding performance, however, is limited by the maximum admissible temperature of the material to be ground (80° to 100° C.) as well as by the cooling water quantity that can be sprayed into the grinding groove without causing a floating (aquaplaning) of the tool.

Another disadvantage of this process is that, for environmental reasons, a cooling water circuit with a corresponding grinding dust separator is required, since cooling water containing grinding dust rapidly leads to a reduction of the grinding performance as well as to burns on the material to be ground.

SUMMARY OF THE INVENTION

In view of the above, an objective of the present invention is to provide an apparatus for producing driving belts designed as single or multi-component V-belts with a high geometric accuracy and at an increased production speed. A further objective is to provide such apparatus together with an environmentally compatible and less complex and costly cooling system.

In accordance with the apparatus corresponding to the invention, the production time for a multi-component V-belt can be reduced by approximately 70%, when compared to known apparatuses. Tests have shown that a multi-component V-belt about 1.2 m in circumferential length, for example, can be finish-ground in a single cycle in approximately 3 seconds. During this process, the temperature of the driving belt and of the grinding tool is below 60° C., whereby the driving belt material is subject only to a favorably low thermal stress.

The fact that the driving belt is treated in dry condition with an actively cooled grinding tool is of decisive importance for these production results. As compared with the known wet grinding devices, the advance and the circumferential speed of the grinding tool are considerably increased while a floating of the grinding tool and/or a burning of the material to be ground are avoided. It is especially important that, in contrast with known wet grinding processes, the grinding dust can be easily collected in an ecologically safe manner by means of a suction device and incorporated in rubber compounds for the manufacture of new belts without requiring any subsequent treatment such as drying or cutting.

A further advantage of the invention is that the reduced production time results in an approximately 90% decrease in the specific energy required for grinding one driving belt.

BRIEF DESCRIPTION OF THE APPLICATION DRAWINGS

The invention is illustrated in detail by the application drawings, in which.

DETAILED DESCRIPTION OF THE PREFERRED EMBODIMENTS

Figure 1:
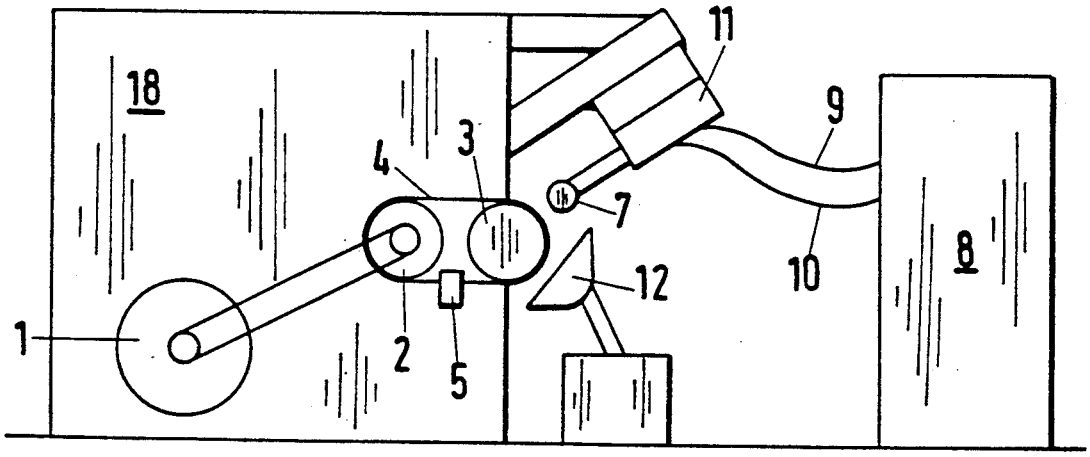
FIG. 1 is a schematic side view of the entire apparatus.

Referring to FIG. 1, the apparatus of the invention illustrated consists of a machine frame 18 provided with a motor 1 as well as two hinge-mounted rolls 2, 3 that are driven by the motor 1. The driving belt 4 to be treated is clamped by rolls 2, 3 and prevented from laterally deviating in parallel to the axes of rolls 2, 3 by means of at least one stop 5, with two stops 5 and 6 being shown in FIG. 2.

The machine frame 18 has mounted thereon at least one adjusting device 11 for a grinding tool 7, with the adjusting device functioning to move the grinding tool 7 towards the belt 4 to be treated. The adjusting device 11 is designed as a mechanical spindle drive, although hydraulic or pneumatic adjusting devices could fulfill the same function.

The grinding tool 7 is connected by means of a supply line 9 and a return line 10 to the cooling unit 8, which provides the grinding tool 7 with a cooling medium that is subsequently returned in hot condition. The cooling medium cools the interior of the grinding tool 7, thereby permitting the grinding process to be effected in dry conditions.

A suction device 12 is provided for sucking off and collecting the grinding dust, with the dust, if desired, subsequently being delivered to a unit for further processing.

Figure 2:
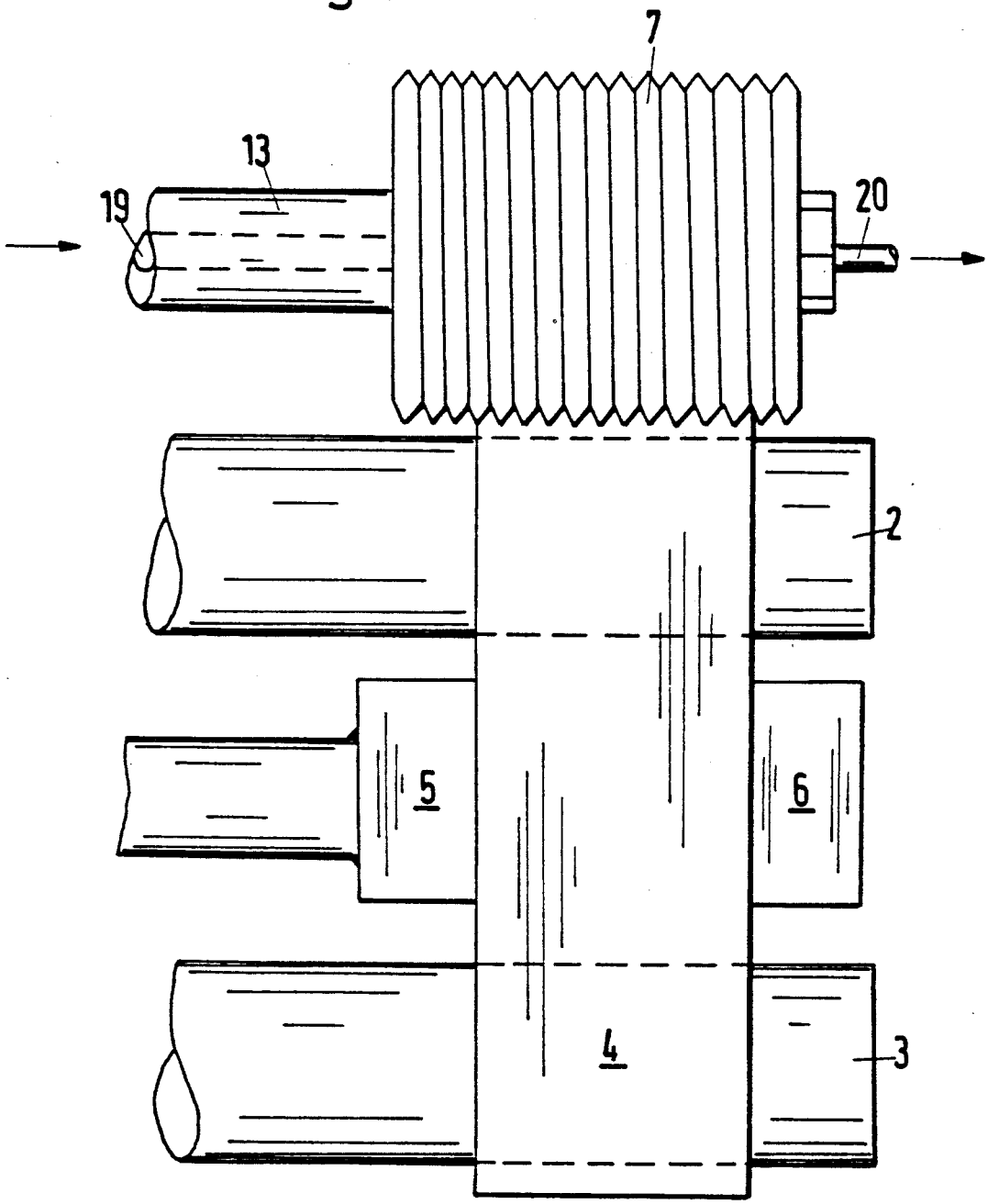
FIG. 2 is a detailed drawing of a grinding tool and a driving belt clamped on two tensioning rolls.

FIG. 2 is a schematic representation of the contact between the grinding tool 7 and the driving belt 4 to be treated. With this embodiment, the driving shaft 13 of the grinding tool 7 is provided with a central bore 19, via which the cooling medium can be supplied to supply line 9 to the interior of the grinding tool 7. The heated cooling medium is discharged via line 20 which communicates at the axially opposite end of the grinding tool 7 with return line 10.

The driving belt 4, which is still untreated at this stage, is prevented from laterally deviating by two adjustable stops 5 and 6, thereby precisely positioning the belt 4 on the rolls 2, 3. Although two stops are preferred, a single stop 5 would be sufficient for this purpose, in view of the fact that rolls 2, 3 are of hinge-mounted design.

Figure 3:
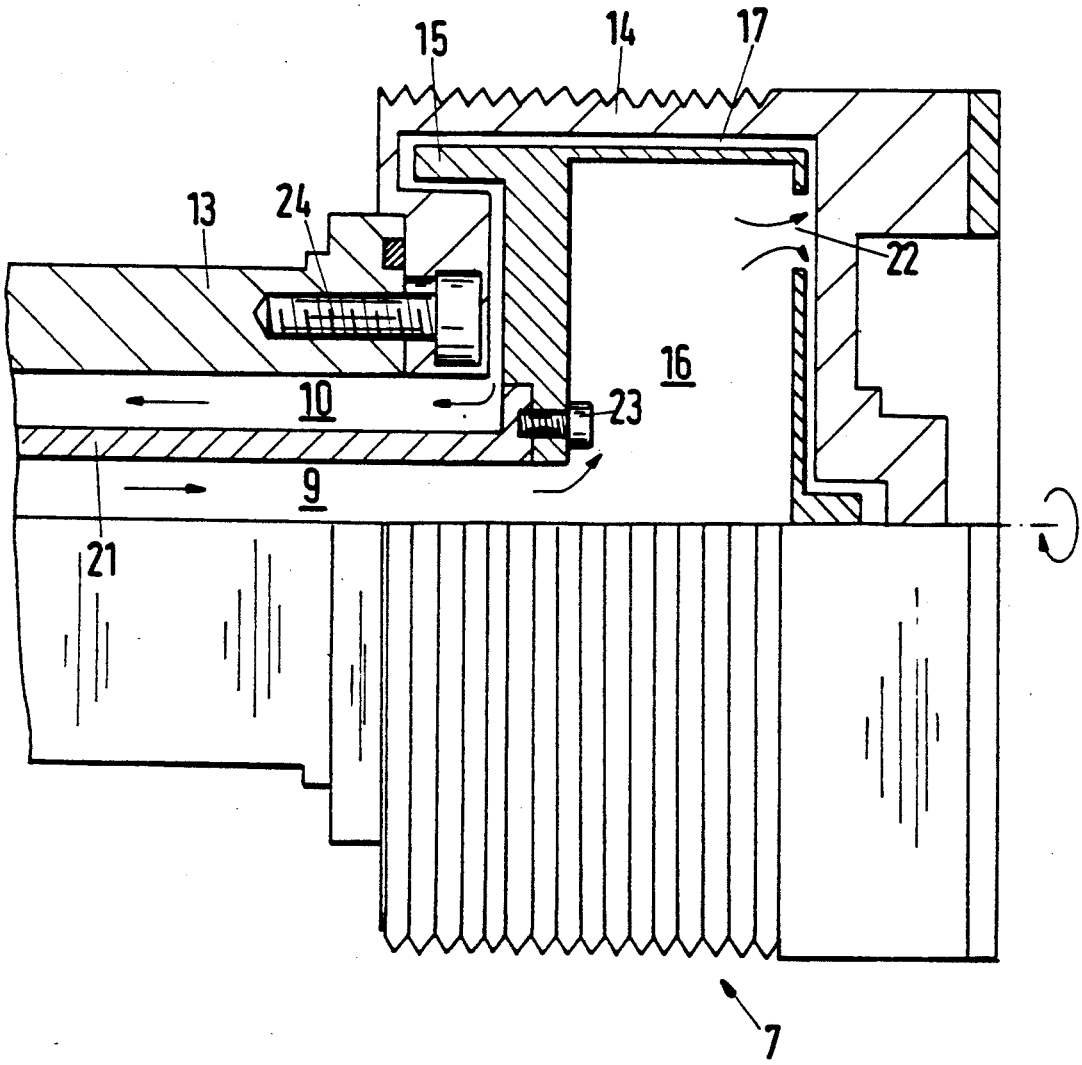
FIG. 3 is a partly sectional view of a grinding tool with an integrated cooling device.

FIG. 3 is a partly sectional representation of a grinding tool 7 with the cooling medium being guided via lines 9, 10 in the driving shaft 13, such as to ensure that the cooling medium supply and return is effected in the area of the drive side end of the driving shaft 13. The cooling medium supply line 9 is in the form of a fixed central pipe 21 (only half of which is visible in FIG. 3), the downstream end of which leads into a collecting chamber 16. The collecting chamber 16 is formed by a hollow internal cylinder 15 which is integrated into the grinding tool 7 and connected to the downstream end of the central pipe 21 by means of fixing elements 23.

This firmly fixed internal cylinder 15 is surrounded by and spaced from an external cylinder 14 which is fastened by means of fixing elements 24 to the driving shaft 13, so as to form an annular gap 17 between the internal cylinder 15 and the external cylinder 14.

Openings 22 in the wall of the internal cylinder 15 allow the cooling medium entering the collecting chamber 16 via the supply line 9 to pass into the annular channel 17 and subsequently to the return line 10 formed by the outer wall of the central pipe 21 and the inner wall of the hollow driving shaft 13.

The profiled external cylinder 14 is of metallic construction and carries the abrasive grinding material. The metallic cylinder presents only a minor wall thickness (approx. 5 mm) in the area of the annual channel 17, so as to ensure an optimum heat conduction from the grinding process to the cooling liquid. An intensive cooling of the grinding tool 7 to approximately 5° C. permits a considerable increase in the abrasion performance with an environmentally compatible dry grinding process.

In another embodiment, the internal surface of the cylinder 14 or the external surface of the cylinder 15 is formed with helical flights which are parallel with the axis of revolution of the shaft 13, thus forming channels through which the cooling medium passes. In another embodiment, in addition to the annular gap 17 and possibly the flight channels arranged on the cylinders 14 or 15 parallel to the axis, bores are provided parallel to the axis thereby allowing the passage of the liquid cooling medium. In this manner, the heat transfer surface can be additionally enlarged, thus improving the cooling capacity of the device according to the present invention.

What is claimed is:

1. An apparatus for producing driving belts, said apparatus including a driveable clamping unit for a reinforced and vulcanized semifinished belt, at least one shaping grinding tool having a driving shaft with an axis, a collecting device for the grinding dust, and a cooling unit for delivering cooling liquid to the grinding tool, wherein the clamping unit consists of two rolls, and means mounting said rolls so that the rolls can be swivelled one against the other, at least one stop that extends towards these rolls and laterally fixes the position of the belt, and wherein the shaping grinding tool is provided with an integrated liquid cooling device for cooling the interior of the grinding tool thereby permitting a dry grinding process, said liquid cooling device including a driveable external cylinder that supports the abrasive grinding material, a stationary internal cylinder, and an annular gap between said external and internal cylinders to which cooling liquid is directed.

2. The apparatus according to claim 1, wherein one of said internal and external cylinders is formed with a helical flight which projects into said annular gap, said flight being arranged in parallel to the axis of the shaft and forming cooling channels for the cooling medium.

3. An apparatus according to claim 1, wherein said external cylinder is formed with bores arranged in parallel to said shaft and through which cooling medium can pass.

4. An apparatus according to claim 1, further including a supply line interiorly of the grinding tool for delivering cooling medium to a collecting chamber which communicates with said annular gap, and a cooling medium return line also formed interiorly of said tool and communicating with said gap for discharging heated cooling medium from said gap.

5. An apparatus according to claim 4, wherein said supply line is defined by a central pipe fixed interiorly of said grinding tool, the outer surface of said pipe partially defining said return line.

6. An apparatus according to claim 5 wherein said central pipe is fixed at its leading end to said internal cylinder, the latter defining said collecting chamber.

7. An apparatus according to claim 4, wherein said supply line and said return line are within said shaft of said grinding tool, said external cylinder being secured to said shaft for rotation therewith.

* * * * *